US006408893B1

(12) United States Patent
Wang

(10) Patent No.: US 6,408,893 B1
(45) Date of Patent: Jun. 25, 2002

(54) TUBULAR BAG WITH VENTILATION BANDS AND METHOD OF MAKING

(75) Inventor: Ching-Lin Wang, Oakland, CA (US)

(73) Assignee: Eagle Bag Corporation, Oakland, CA (US)

( * ) Notice: Subject to any disclaimer, the term of this patent is extended or adjusted under 35 U.S.C. 154(b) by 0 days.

(21) Appl. No.: 09/939,336

(22) Filed: Aug. 24, 2001

Related U.S. Application Data

(60) Provisional application No. 60/228,318, filed on Aug. 25, 2000.

(51) Int. Cl.[7] ..... D03D 41/00

(52) U.S. Cl. ..... 139/11; 139/1 R; 139/457; 139/389

(58) Field of Search ..... 139/1 R, 11, 457, 139/16, 18, 333, 387 R, 389

(56) References Cited

U.S. PATENT DOCUMENTS 4,025,684 A * 5/1977 Neidhardt ..... 138/124
4,048,399 A * 9/1977 Terzaghi ..... 139/387 R
4,055,201 A * 10/1977 Fowler et al. ..... 139/387 R
5,356,692 A * 10/1994 Perez ..... 118/33
5,387,300 A * 2/1995 Kitamura ..... 139/387 R
5,395,665 A * 3/1995 Planeta ..... 139/389

* cited by examiner

*Primary Examiner*—Amy B Vanatta
*Assistant Examiner*—Robert H. Muromoto, Jr.
(74) *Attorney, Agent, or Firm*—Chi Ping Chang; Pacific Law Group LLP

(57) ABSTRACT

A specialty bag is formed from a circular loom adapted with a unique mechanism of the current invention such that the resulting woven tubular sheet contains at least one venting band extending along the length of the tubular sheet. The tubular sheet is then cut into individual bag segments. The individual bag segments are sewn together along their bottom edge to form the final bag having at least one venting band for the proper venting of the enclosed items.

6 Claims, 6 Drawing Sheets

TUBULAR BAG WITH VENTILATION BANDS AND METHOD OF MAKING

REFERENCE TO RELATED APPLICATION

This application is a formal application based on provisional application filed on Aug. 25, 2000, Ser. No., 60/228, 318.

TECHNICAL FIELD OF THE INVENTION

This invention concerns a specialty bag construction and method of manufacturing the same. In particular, the bag wall has a number of venting bands for the proper venting of certain stored perishable items.

BACKGROUND OF THE INVENTION

Bulk bags are commonly used to store and transport many agricultural products. Many such products, especially those easily perishable ones, require the bag to be properly vented to prevent the build up of excessive moisture with ensuing growth of mold and deterioration of the content. Furthermore, these bags are usually non-reusable due to sanitation concern. Thus, these ventable bags need to be produced in high volume, having a specifiable degree of venting yet with very low cost. One common way to achieve this is to weave in a set of venting bands of specified width and density with a flat loom. However, the associated post operation involves, after cutting the panel to size, folding and sewing of two lines to form the bag. Additionally, the flat loom machine is quite an expensive investment. Thus, the overall production cost of the bag can be undesirably high.

SUMMARY OF THE INVENTION

The present invention consists of a method which inexpensively and efficiently manufactures such ventable bags in high volume with a specifiable range of design of venting bands. Thus, the bag itself is also encompassed by the present invention.

The bag is a traditional one having a cylindrical body panel with one end of the panel sown closed to form the storage cavity. The other end of the cylindrical body panel is left open for communication with the interior of the bag. However, the cylindrical body panel of the bag comprises a specified number and location of venting bands along the direction of the cylindrical axis. Furthermore, the width of the said venting bands is also specifiable by design.

The method of manufacturing the bag starts with the tubular weaving of yams of proper materials with a circular loom whereby an elongated tubular structure is formed with woven warp and weft strands. The direction of the warp strands is parallel to the tubular axis whereas the direction of the weft strands is perpendicular to the tubular axis.

However, around the periphery of a concentration ring of said circular loom a number of mechanical expansion blocks are disposed at the proper location replacing the otherwise warp strands to be fed thus woven into said cylindrical body panel of the bag. For convenience, these locations are to be called band locations. As there is an absence of warp strands at each such band location, the resulting woven wall structure of the said band consists of only weft strands. Without the interlocking power from the missing warp strands, the flexing weft strands within said band create substantially larger air gaps in between than otherwise possible with the presence of interlocking warp strands. These air gaps within said bands thus form the desired venting structure for the bag. Therefore, emerging from said circular loom with the adaptation of the invention embodiment is a woven tubular structure wherein a number of venting bands parallel to the tubular axis are built in wherever said invention embodiment is disposed along the circumferential periphery of the tube. It is also important to remark that, as part of the function of the circular loom, said emerging woven tubular structure is actually flattened into a continuous belt form and wound into a roll for easiness of subsequent handling.

The tubular structure is sectioned off along a set of lines with predetermined spacing to form a set of tubular segments, each tubular segment having the desired set of venting bands extending axially from a first open end to a second open end. For convenience, the first open end of the said tubular structure is to be called the top opening and the second open end of the said tubular structure is to be called the bottom opening.

The bottom opening of the said tubular structure is now sewn closed along the direction perpendicular to the tubular axis. The top opening of the said tubular structure is left open forming the desired bag opening.

Thus, a storage bag having a cylindrical body panel is described wherein a desired set of venting bands extending axially is built in on the body panel. Additionally, an inexpensive and efficient method is described herein for the manufacturing of such ventable bags in high volume. Furthermore, said method of manufacturing embodies the adaptation of a set of simple mechanical elements onto an existing circular loom.

Other features, objects and advantages of the present invention will become apparent with reference to the following drawings and associated descriptions.

DETAILED DESCRIPTION OF THE INVENTION

Figure 5:
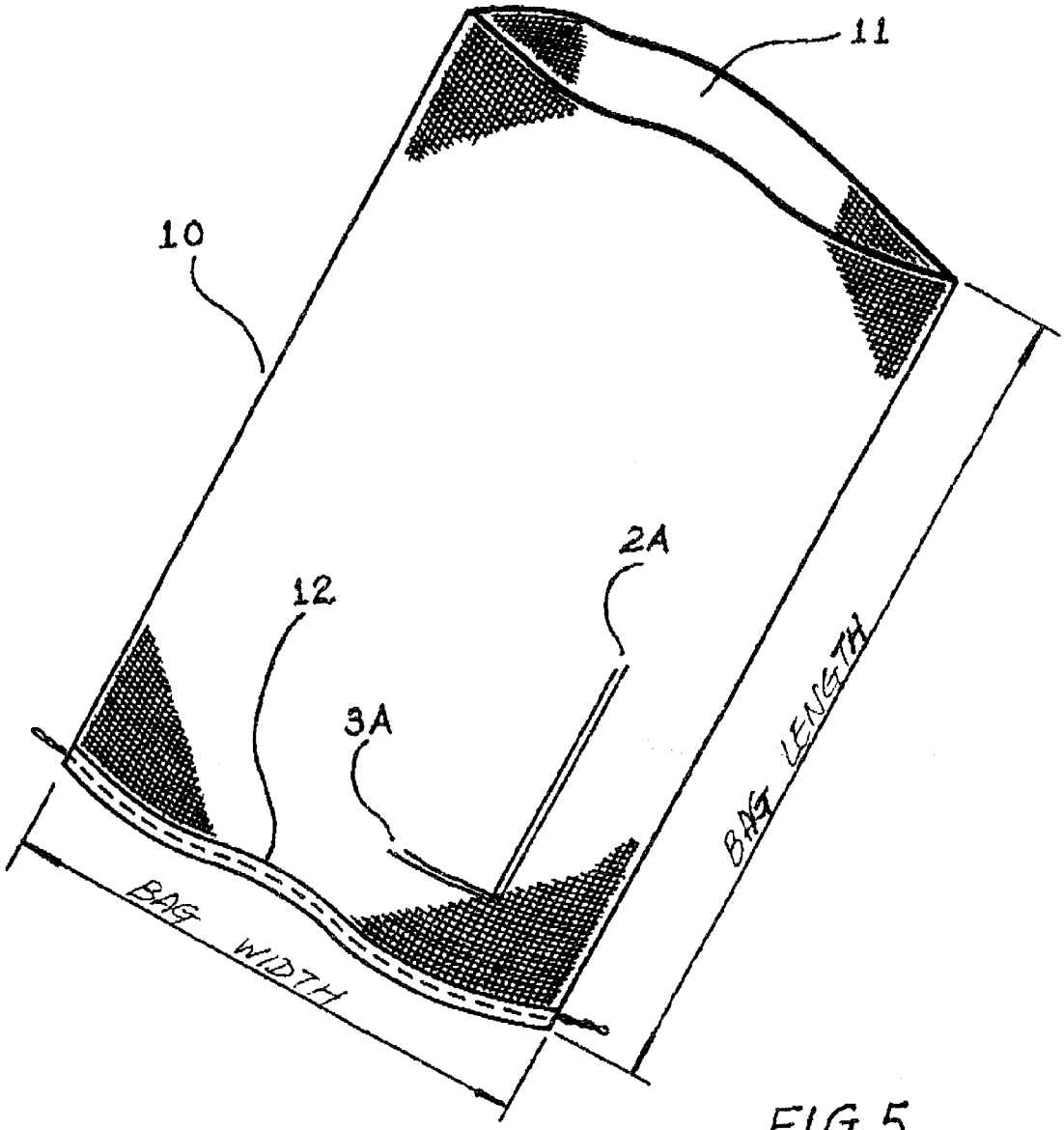
FIG. 5 Prior Art
FIG. 5 illustrates a prior art finished bag made from a section of a woven tubular structure coming out of an unmodified circular loom, after the bottom opening of the sectioned tubular structure is sewn closed.

FIG. 5 illustrates a typical prior art bulk bag made with a circular loom. The cylindrical body panel 10 comprises many tightly interlocking strands of woven warp 2A and woven weft 3A woven by a well-known circular loom machine. The material for the warp and weft strands can be any of the many materials compatible with the circular loom. Some examples are polyethylene, polypropylene and nylon. It is important to remark that, as part of the function of the circular loom, the said emerging woven cylindrical body panel 10 is actually flattened into a continuous belt form and wound into a roll for easiness of subsequent handling. The bottom opening of the cylindrical body panel 10 is sewn closed to form a sewn bottom edge 12. The top opening 11 comes naturally out of the sectioning operation of the tubular body structure into bag segments.

Although many such bulk bags are commonly used to store and transport a wide variety of products and materials, many such products, especially those easily perishable ones, require the bag to be adequately vented to the ambient to prevent the build up of excessive moisture with ensuing growth of mold and deterioration of the content. Some examples are potatoes and vegetables. For such products, the tightly interlocking strands of woven warp 2A and woven weft 3A of the prior art bulk bag does not allow adequate degree of venting to the ambient and means of controllably increasing the degree of venting must be devised to solve the problem.

Figure 6:
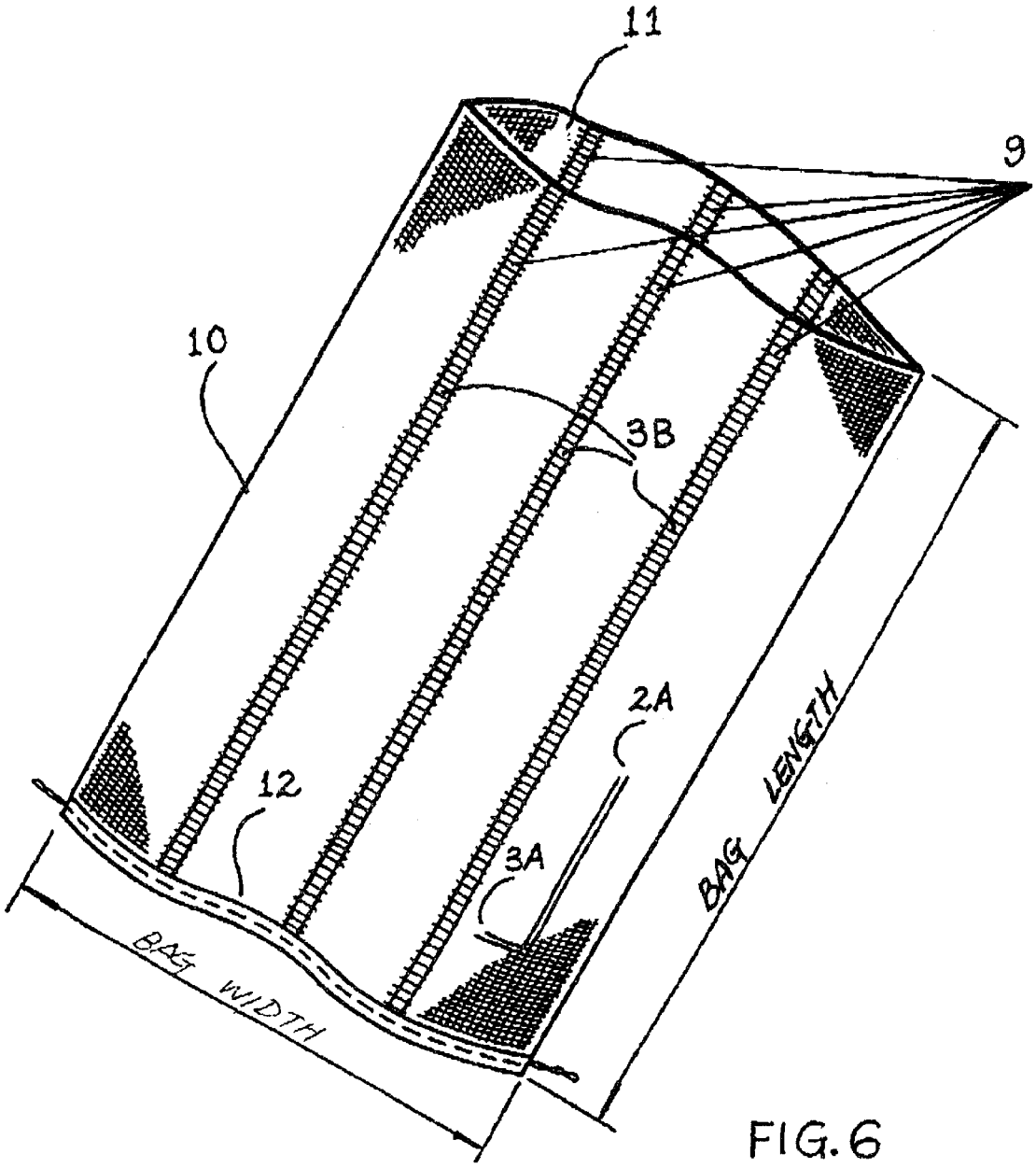
FIG. 6 illustrates a finished bag made from a section of a woven tubular structure coming out of a circular loom modified with the present invention, after the bottom opening of the sectioned tubular structure is sewn closed.

FIG. 6 illustrates a bulk bag from the present invention whereby the desired degree of increase of venting is accomplished. As stated above, the cylindrical body panel 10 comprises many tightly interlocking strands of woven warp 2A and woven weft 3A. The bottom opening of the cylindrical body panel 10 is sewn closed to form a sewn bottom edge 12. The top opening 11 comes out of the sectioning operation of the tubular body structure into bag segments. However, around the periphery of the cylindrical body panel 10 a set of venting bands 9 is disposed. Within each venting band 9, instead of having both warp and weft strands, only woven weft in venting band 3B exists. Without the interlocking power from the missing woven warp 2A, the flexing woven wefts in venting band 3B within the said venting band 9 now create substantially larger air gaps in between than otherwise possible with the presence of interlocking woven warp 2A. These air gaps within said venting band 9 thus form the desired venting structure for the bag of the present invention. The method by which these venting bands 9 on the cylindrical body panel 10 are manufactured is described below.

Figure 1:
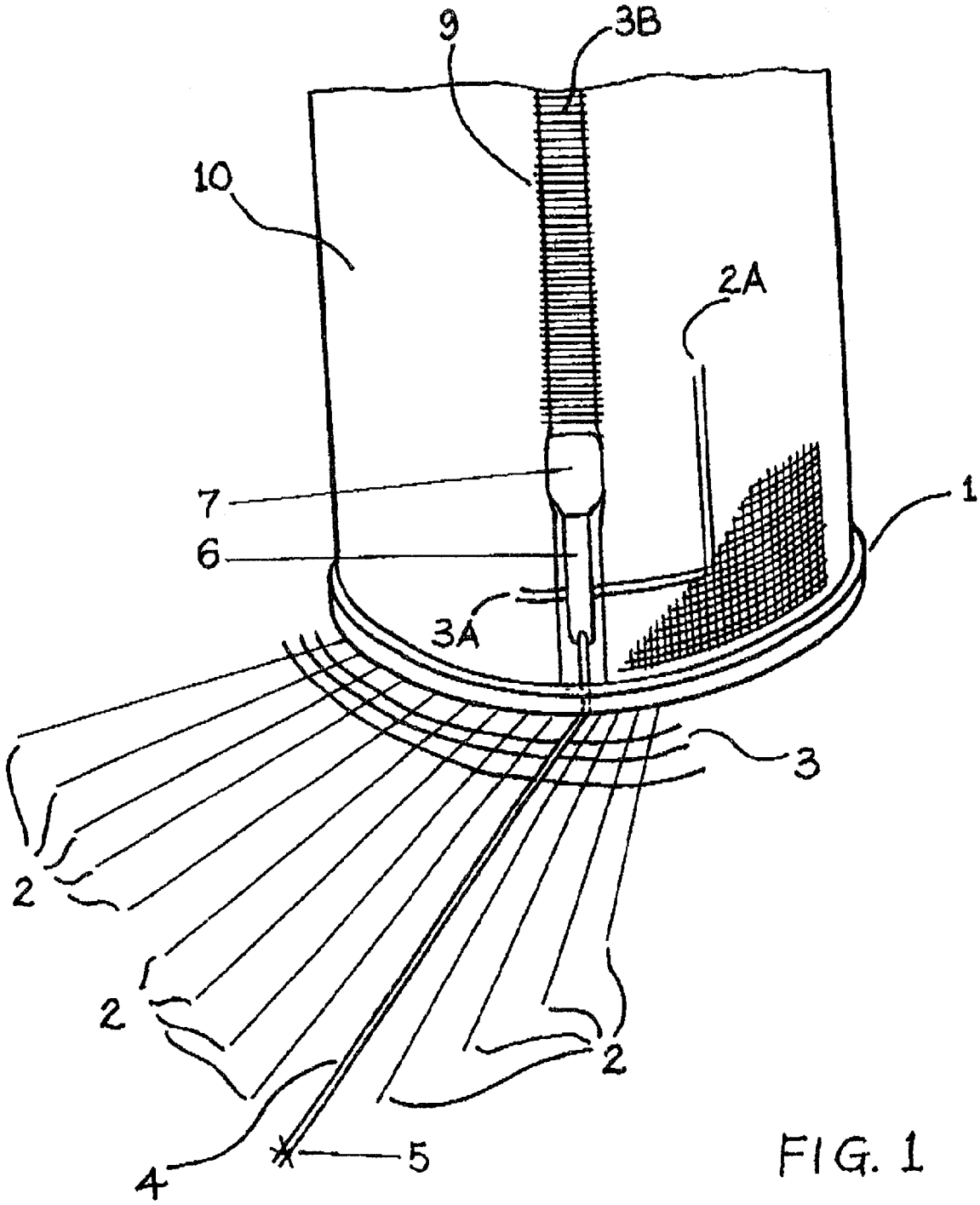
FIG. 1 is a perspective view of a portion of the weaving mechanism inside a circular loom wherein one mechanical expansion block of the present invention is disposed to replace an otherwise corresponding group of warp yarns feeding the weaving mechanism.

The method of manufacturing the bag starts with the tubular weaving of yarns of warp and weft materials with a well-known circular loom whereby an elongated tubular structure is formed with woven warp and weft strands. FIG. 1 is a perspective view of a portion of the weaving mechanism inside a circular loom wherein a full circle of radially converging warp strands 2 are interlockingly woven with another set of circumferentially directed weft strands 3. For easiness of viewing, neither the full set of warp and weft strands nor the circular-weaving heads are shown. After passing through the underside of a concentration ring 1, the just woven cylindrical web turns vertical in direction, forming a cylindrical body panel 10 and continues to be pulled upwards toward an ultimate take up roller which is not shown here. The direction of the woven warp 2A is parallel to the tubular axis whereas the direction of the woven weft 3A is perpendicular to the tubular axis.

Around the periphery of the concentration ring 1 of said circular loom a number of expansion blocks 7 are disposed at the proper location replacing the otherwise converging warp strands 2 to be fed thus woven into said cylindrical body panel 10 of the bag. For convenience, these locations are to be called band locations. For simplicity, only one expansion block 7 is shown. The expansion block 7, through a cylindrical link 6, is attached to a flexible belt 4 whose outer end is fixed at a convenient tie point 5 on the frame of the circular loom.

Figure 2:
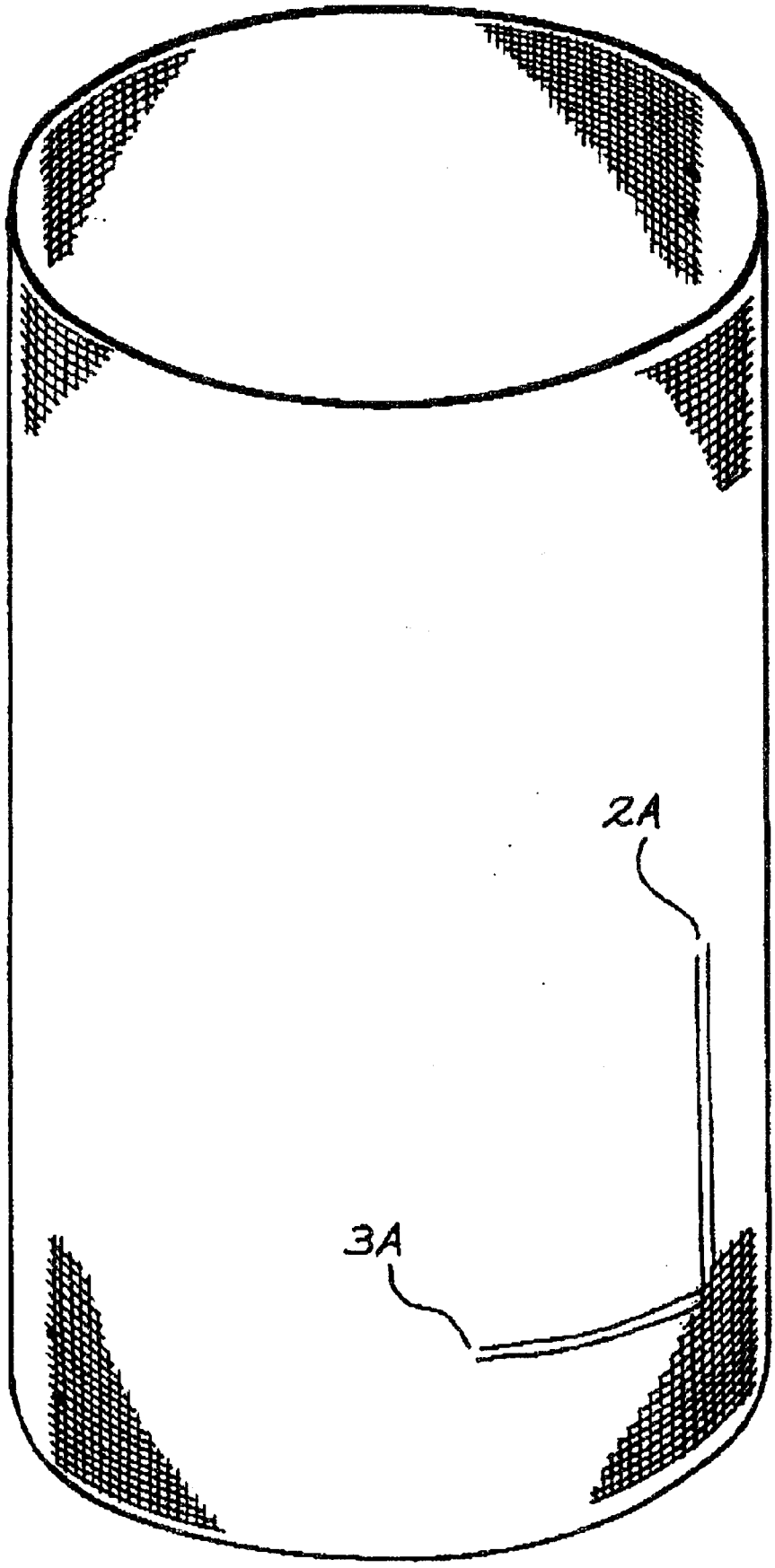
FIG. 2 illustrates a section of a woven tubular structure coming out of an unmodified circular loom wherein the woven warp and weft strands are partially shown to illustrate their orientation.
Figure 3:
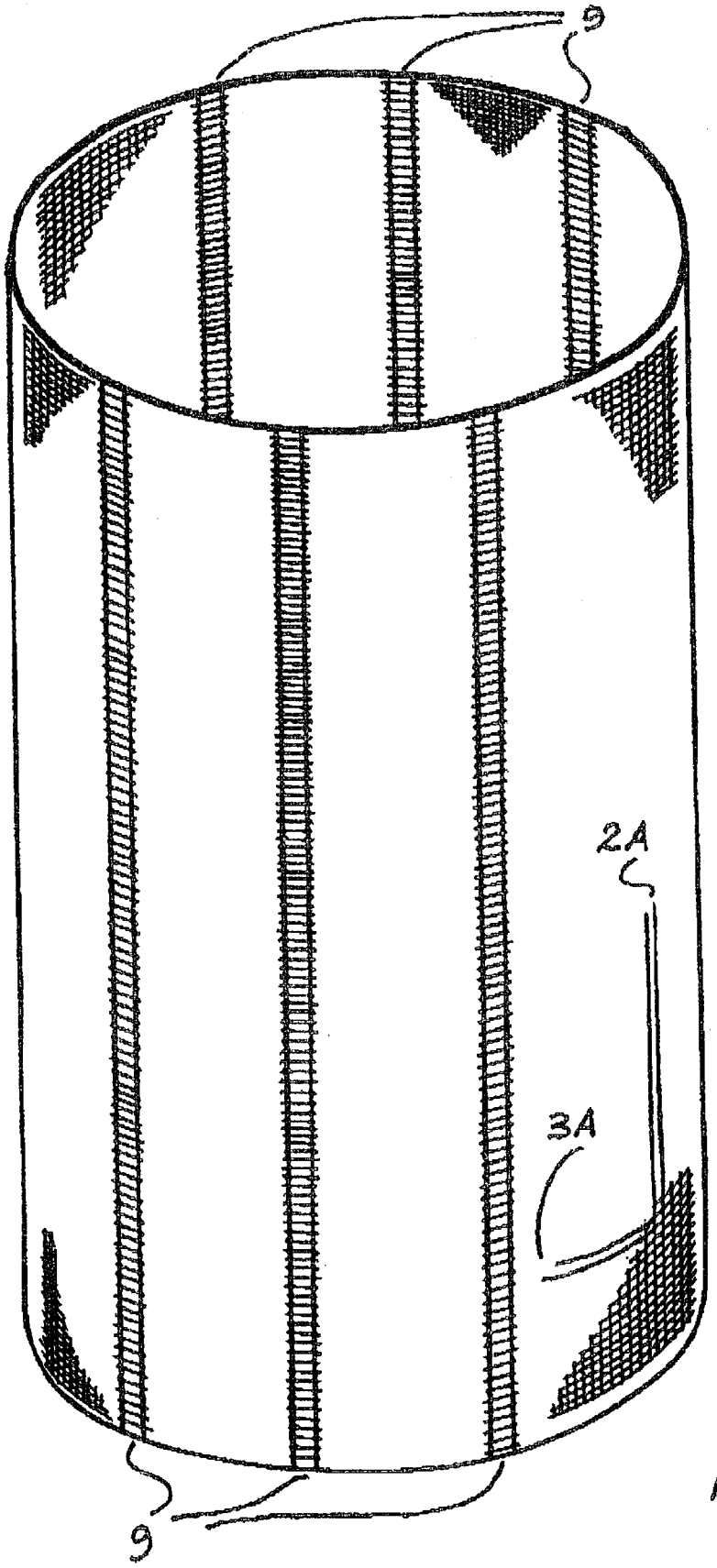
FIG. 3 illustrates a section of a woven tubular structure coming out of a circular loom modified with the present invention wherein a set of six venting bands made with the present invention is also illustrated.

The absence of woven warp 2A at each such band location results in the presence of only woven weft 3B in said venting band 9. Without the adaptation of the present invention, as illustrated in FIG. 2, a totally symmetric cylindrical structure would be formed wherein the whole cylindrical wall comprises tightly interwoven warp 2A and woven weft 3A. Whereas with the present invention, as shown in FIG. 3, a woven tubular structure wherein a number of venting bands 9 parallel to the tubular axis are produced wherever the invention embodiment is disposed along the circumferential periphery of the tube.

Figure 4:
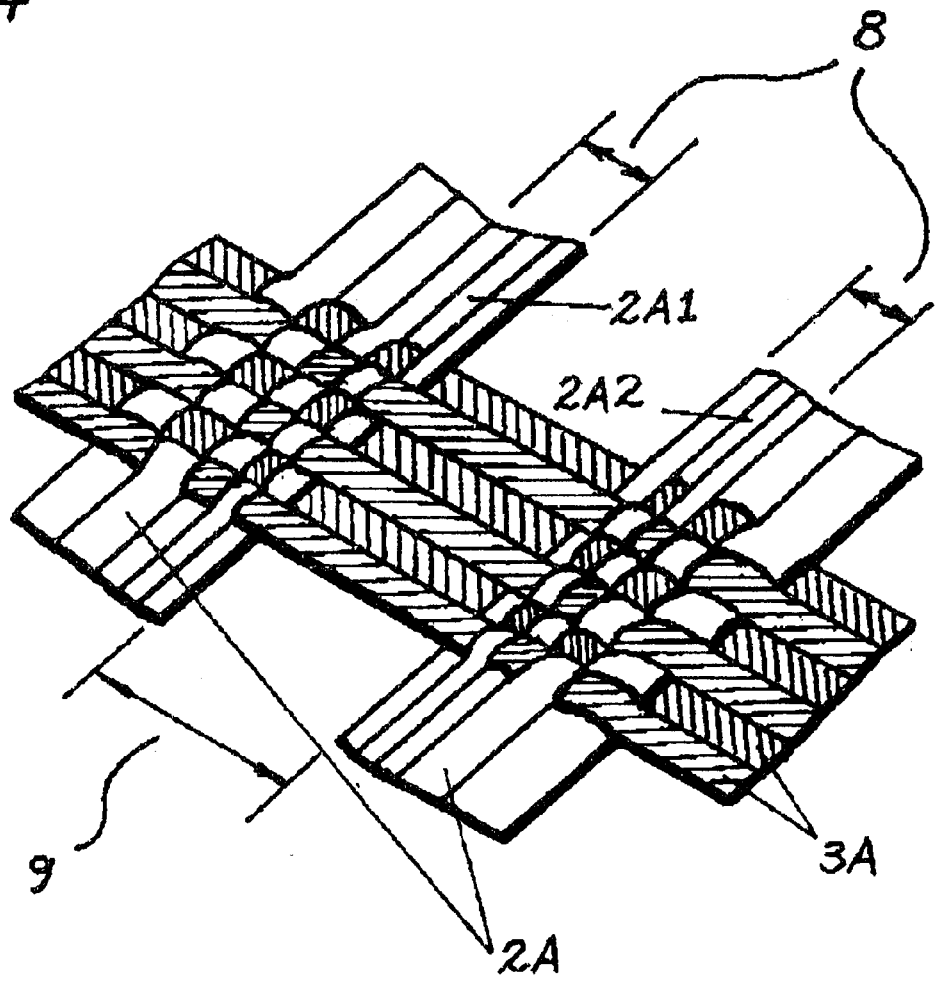
FIG. 4 is a perspective illustration of a small section of the detailed woven structure including the corresponding section of a venting band made with the present invention.

Additionally, with reference to FIG. 1, the width of the expansion block 7 is intentionally oversized with respect to the replaced width of the missing warp strands 2. Thus, during the weaving operation, a controlled amount of lateral squeezing force is produced which causes a closer packing of the woven warp 2A along the edge of the venting band 9. This is illustrated in FIG. 4 which shows a perspective view of a small section of the detailed woven structure including the corresponding section of a venting band 9 made with the present invention. Along the two edges of the venting band 9 are formed two squeeze zones 8 wherein both the woven warps in left squeeze zone 2A1 and the woven warps in right squeeze zone 2A2 are packed with a pitch tighter than elsewhere on the woven web.

It should be understood that, with the present invention, the amount of venting for the bulk bag can be flexibly controlled with the proper combination of the selection of number, location and size of the expansion block 7. The invention is applicable, in particularly, to the storage and transportation of potatoes where a proper degree of venting is needed to prevent the growth of mold thus causing deterioration of the potato while avoiding excessive sun exposure which also causes another type of deterioration.

I claim:

1. A method of manufacturing a specialty tubular bag wherein the tubular bag wall has at least one venting band extending along a length of a corresponding tubular sheet, said method comprising the steps of:

weaving a tubular sheet of flexible material with a circular loom to form an elongated tube comprising woven warp and weft strands, with said tubular sheet having a longitudinal axis parallel to said warp strands and a transverse axis parallel to said weft strands;

adapting, during said weaving step with said circular loom, at least one expansion block disposed with an associated means of fixturing said expansion block around a periphery of a concentration ring of said circular loom whereby said expansion block is used to replace a corresponding group of otherwise normally supplied warp strands to be woven;

creating, along the periphery of the woven tubular sheet, a set of said venting bands each corresponding to the location of an expansion block, where each venting band runs parallel to said longitudinal axis, said weft strands and said warp strands surrounding the said expansion block;

sectioning off said tubular sheet along a set of lines perpendicular to said longitudinal axis and with a predetermined spacing to form a set of tubular segments, whereby each said tubular segments comprising said set of venting bands extending longitudinally from a first open end to a second open end with the first open end of said tubular sheet named the top opening and the second open end of said tubular sheet named the bottom opening; and sewing said bottom opening of said tubular sheet closed along a direction perpendicular to the said longitudinal axis with said top opening of said tubular sheet left open forming a desired bag opening.

2. The method according to claim 1 further comprises the step of adjusting a width of the woven width from the replaced group of missing warp strands with the selection of a number of said missing warp strands such that a width of the resulting venting band is adjusted accordingly along a transverse direction.

3. The method according to claim 2 wherein the number and peripheral location of the said groups of missing warp strands are selected as part of the setup of the circular loom to produce the corresponding number and peripheral location of said venting bands.

4. The method according to claim 1 further comprises the step of selecting a width of said expansion block along the transverse direction to be wider than the woven width from the replaced group of missing warp strands such that a controlled amount of lateral expansion force is exerted by said expansion block onto the warp strands surrounding said venting band, causing a closer packing of the woven warp strands along both edges of said venting band than elsewhere on the woven web, thus insuring the consistency and cosmetic appearance of the resulting venting band.

5. The method according to claim 4 further comprises the step of adjusting a height of the said expansion block along the longitudinal direction such that, during the weaving operation, said lateral expansion force exerted by said expansion block onto the warp strands surrounding said venting band can be adjusted accordingly to cause an adjustable degree of closer packing of the woven warp strands along both edges of said venting band than elsewhere on the woven web.

6. The method according to claim 5 further comprises the step of adjusting the elevation of said expansion block above a concentration ring of said circular loom such that said lateral expansion force exerted by said expansion block onto the warp strands surrounding said venting band can be adjusted accordingly to cause an adjustable degree of closer packing of the woven warp strands along both edges of said venting band than elsewhere on the woven web.

* * * * *